US005450912A

United States Patent [19]

Cahill et al.

[11] Patent Number: 5,450,912

[45] Date of Patent: Sep. 19, 1995

[54] MAINTENANCE AND EXTRACTION OF POLES

[75] Inventors: Gavin J. Cahill; Ronald W. Lousick; Eric A. Falkenhagen, all of Cairns, Australia

[73] Assignee: Polemate Pty Ltd., Queensland, Australia

[21] Appl. No.: 137,043

[22] PCT Filed: Apr. 16, 1992

[86] PCT No.: PCT/AU92/00169

§ 371 Date: Dec. 14, 1993

§ 102(e) Date: Dec. 14, 1993

[87] PCT Pub. No.: WO92/18705

PCT Pub. Date: Oct. 29, 1992 (Under 37 CFR 1.47)

[30] Foreign Application Priority Data

Apr. 19, 1991 [AU] Australia ..... PK5711

[51] Int. Cl.[6] ..... E21B 7/00

[52] U.S. Cl. ..... 175/57; 175/195; 37/189; 37/406; 173/27; 173/192; 414/23; 414/733

[58] Field of Search ..... 175/57, 195; 37/189, 37/406; 173/27, 192; 414/23, 733

[56] References Cited

U.S. PATENT DOCUMENTS

| | | | |
|---|---|---|---|
| 2,526,984 | 10/1950 | Weishaar | 255/21 |
| 2,631,013 | 3/1953 | Darin | 255/19 |
| 2,721,664 | 10/1955 | Barfield | 214/3 |
| 3,317,185 | 5/1967 | Burk et al. | 254/30 |
| 3,323,234 | 6/1967 | Pickrell | 37/103 |
| 3,589,039 | 6/1971 | Korenek | 175/244 X |
| 3,595,182 | 7/1971 | Clapp | 111/6 |
| 3,933,261 | 1/1976 | Marostica et al. | 214/138 R |
| 4,199,033 | 4/1980 | Van Gundy | 173/27 |
| 4,697,649 | 10/1987 | Kinnan | 175/195 X |

FOREIGN PATENT DOCUMENTS

| | | |
|---|---|---|
| 55-36563 | 9/1978 | Japan . |
| 974868 | 11/1964 | United Kingdom . |

*Primary Examiner*—Roger J. Schoeppel
*Attorney, Agent, or Firm*—Nixon & Vanderhye

[57] ABSTRACT

An apparatus for excavation of earth around a pole embedded in an earth surface comprises a hollow auger in the form of a cylindrical drum with a helical flight about the outer wall thereof. The hollow auger is constructed in two halves to enable movement between an open position and a closed position embracing the pole. The hollow auger is rotatably journalled in a support frame and is driven by a drive motor engaging a spur gear around the upper position of the auger. The support frame is slidably mounted on a frame to enable extension and retraction of the auger.

14 Claims, 3 Drawing Sheets

MAINTENANCE AND EXTRACTION OF POLES

This invention is concerned with maintenance and extraction of poles piers and piles from earth surfaces.

In particular, this invention is concerned with maintenance and extraction of timber, concrete and steel poles and like supports for power and telephone transmission lines, fence posts, building support piers, marine pilings and the like.

Timber power and telegraph poles are prone to deterioration as a result of fungal and termite attack, particularly in the region extending from the point of emergence form a ground surface to about 600 mm below the ground surface. Concrete and steel poles may also be subject to deterioration as a result of corrosion in a similar region. Marine pilings typically deteriorate over their exposed normally wetted surfaces.

In order to maintain such poles, it is necessary to excavate the earth around the pole to a depth of about 600 mm to inspect the pole condition and to apply timber preservation and protective composition. Typically, such excavations are carried out manually with a pick and shovel.

When it is desired to remove or replace a telegraph or power transmission pole which is damaged as a result of, say, a motor vehicle accident, termite or fungal decay, it is necessary to excavate a substantial amount of earth from around the pole to facilitate removal. A typical method of extracting piles is described and illustrated in Australian Patent No. 524678 which is concerned with a method for sleeving damaged poles. The main disadvantage of this method is that a new or repaired pole is replaced in a ground surface surrounded by a substantial volume of disturbed and uncompacted earth. This may necessitate the use of additional equipment to compact the disturbed earth.

To facilitate extraction of a submerged marine piling, it is common practice to excavate around the base of a piling member by means of a high pressure water cannon.

All of the prior art methods of maintaining and extracting poles, pilings etc are heavily labour intensive and/or require specialised heavy equipment to carry out these functions.

It is an aim of the present invention to provide a method and apparatus for excavation around poles, pilings and the like embedded in an earth surface and to facilitate extraction of those poles, pilings and the like if so required.

As used herein the expression "pole" is intended to embrace all types of poles embedded in earth surfaces on dry land or a sea bed and includes, power poles, telegraph poles, fence poles, piers, pilings and the like.

According to one aspect of the invention there is provided an apparatus for excavation of earth about a pole embedded in an earth surface, said apparatus comprising:

a support frame;

a substantially cylindrical earth excavation member rotatably journalled in said support frame;

drive means to rotate said earth excavation member; and, means to advance said earth excavation member in a desired direction.

Suitably said support frame is adapted for mounting on a mobile vehicle.

Preferably said apparatus includes orientation means to selectively orientate said earth excavation member for earth excavation in a predetermined direction.

If required said apparatus may includes stabiliser means to stabilise the apparatus during excavation.

Suitably the earth excavation member comprises a cylindrical drum with at least one earth working element located on the outer periphery of said drum.

Preferably said at least one earth working element comprises a helical flight.

Preferably said helical flight includes a cutting edge at its leading free end.

If required one or more cutting edges may be associated with a leading portion of said drum.

Preferably said drum comprises a continuous inner wall surface.

If required scraping means may be provided to scrape excavated earth from said helical flight adjacent a trailing end thereof.

Preferably said earth excavation member is comprised of two or more portions movable between an open position and a closed position to embrace an upright pole for earth excavation therearound.

Preferably said earth excavation member includes a drive portion and a removable excavation portion.

Preferably said drive means comprises at least one drive motor adapted to engage a drive portion on said earth excavation member.

Suitably said drive means comprises a rack and pinion drive mechanism.

Preferably said rack and pinion drive mechanism comprises a rack member extending about the periphery of said drive portion.

The means to advance said earth excavation member in a required direction may comprise a carriage associated with said support frame, said carriage being selectively advanceable or retractable by any suitable means.

Alternatively said means to advance said earth excavation member may comprise pole engaging drive means associated with said support frame.

Preferably said apparatus is associated with a mobile vehicle including hoist means to extract a pole from a ground surface after excavation.

According to another aspect of the invention there is provided a method of excavation of earth about the base of a pole embedded in an earth surface, said method comprising the steps of:

surrounding said pole with an earth excavation member comprising a substantially cylindrical drum having a helical flight located about the outer peripheral surface of said drum;

rotating said drum; and, advancing said drum into said earth surface at a predetermined rate to a predetermined distance to effect removal of earth from around said pole.

Preferably said earth excavation member is associated with a mobile vehicle including a support frame in which said drum is rotatably Journalled and retractable means to advance said support frame in a direction of excavation.

Suitably the pole may be extracted by pole extraction means after excavation about said pole.

In order that the invention may be more fully understood, reference is now made to preferred embodiments illustrated in the accompanying drawings in which.

Figure 1:
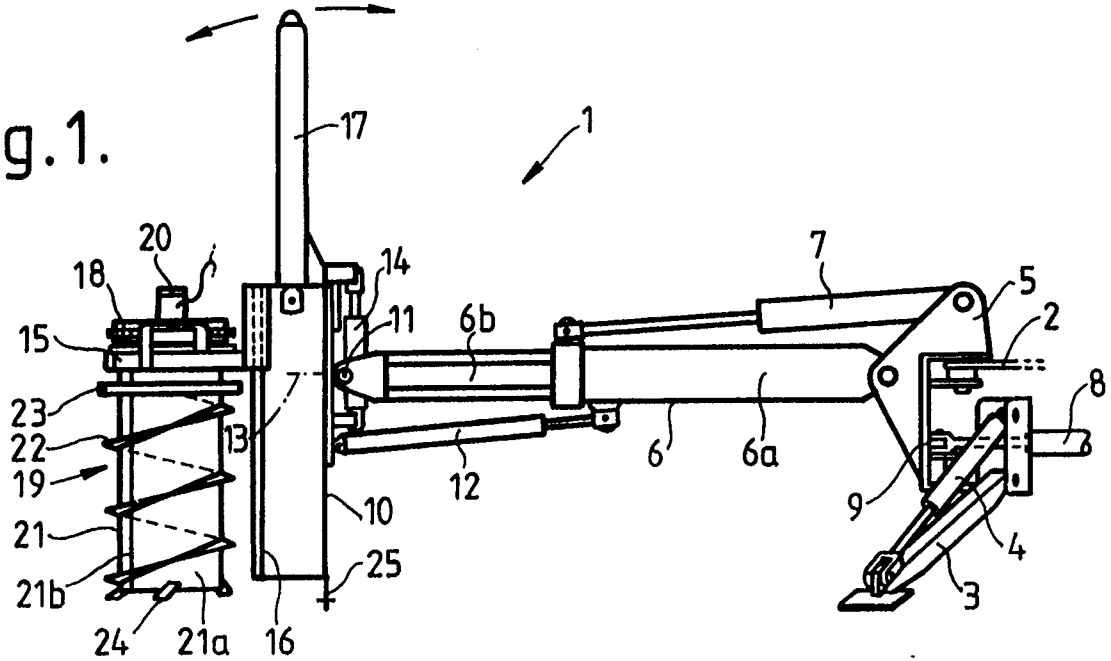
FIG. 1 illustrates a side elevation of a tractor mounted excavation apparatus.

In FIG. 1 the excavating apparatus 1 is shown attached to the rear of a tractor (not shown) and it utilises a source of pressurised hydraulic fluid from the tractor for operation.

Apparatus 1 comprises a tractor mounting bracket 2 with which is associated splayed stabiliser legs 3 powered by hydraulic rams 4.

Pivotally mounted on bracket 2 is a support bracket 5 to which is mounted a telescopic boom 6. Boom 6 is movable between an extended operating position as shown and an upright travelling position by hydraulic ram 7. A hydraulic ram (not shown) is located within outer boom portion 6*a* to telescopically extend or retract inner boom portion 6*b*. A boom slewing ram 8 is connected to an arm 9 extending transversely from bracket 5.

A tiltable frame 10 is pivotally mounted on the end of boom 6 for tiltable movement about a transverse pivot 11 by means of hydraulic ram 12.

The frame 10 is also tiltable about the longitudinal axis of boom 6 about pivot 13 and is tiltable by means of hydraulic ram 14.

A support frame 15 is slidably mounted on slide bars 16 and is movable between an extended position and a retracted position by hydraulic ram 17 mounted on top of frame 10.

Rotatably journalled within support frame 15 is a cylindrical earth excavation apparatus comprising a drive portion 18 and a removable excavation portion 19.

Drive portion 18 includes a spur gear or the like 26 extending about the outer periphery of the drive portion 18 and is rotatable by means of diametrically opposed hydraulic motors 20, each with drive pinions (not shown) engaging with the spur gear.

The excavating portion 19 comprises a cylindrical drum 21 with a helical flight 22 extending thereabout. The leading end of the flight is fitted with a hardened cutting edge.

Drum 21 is attached to the drive portion 18 by bolting together mating flanges 23 on each portion. This enables interchangeability of excavating portions 19 of differing diameters and/or lengths if required.

Mounted on the lower edge of drum 21 are additional cutting edges 24 to assist in loosening the earth for collection by the auger flight 22 when in use.

Support frame 15, drive portion 18 and excavating apparatus 19 are each formed from generally hemicylindrical halves and are adapted for movement by a hydraulic ram (not shown ) between an open position to enable a pole to be embraced and a closed position around a pole for operation. Drum 21 thus comprises two hemicylindrical halves 21*a* and 21*b*.

The operation of the apparatus will now be described.

The tractor mounted apparatus is positioned adjacent a pole (not shown) about the base of which excavation is desired. Stabiliser arms 3 are actuated to stabilise and level the tractor.

The hydraulic ram (not shown) operable to open and close excavating apparatus 19 is actuated to open frame 15 and drive and excavating portions 18 and 19 respectively. Boom 6 is then extended to position the open excavation apparatus relative to the pole and then the excavating apparatus is closed to embrace the pole.

The excavating apparatus is aligned by means of rams 12 and/or 14 relative to the pole and ram 7 is then actuated to lower the apparatus to ground level whereupon a pointed support foot 25 penetrates the earth surface to locate and stabilise frame 10.

Hydraulic motors 20 are then actuated and support frame 15 is then advanced towards the earth surface by ram 17. The rate and extent of advancement of the excavating portion 19 is controlled by ram 17.

As excavating portion 19 rotates and advances downwardly, earth is removed from adjacent the embedded portion of the pole by the helical flight and deposited under centrifugal force around the circular excavation aperture. If required, scrapers may be employed to remove earth adhering to the helical flight.

Ram 17 is then actuated to withdraw the excavating apparatus and any earth trapped between the inner wall of drum 21 and the pole then falls to the bottom of the excavation to expose the normally embedded surface of the pole.

The apparatus described above may be utilised to excavate only to a predetermined depth to expose, for inspection and/or treatment purposes, a portion of the pole normally subject to deterioration or alternatively to excavate around the entire embedded portion to facilitate extraction of the pole.

By employing replaceable auger drum 21 of differing diameters and/or lengths the apparatus is suitable for all pole excavation purposes.

Figure 2:
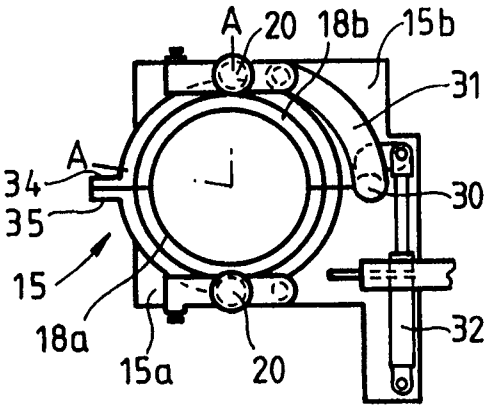
FIG. 2 illustrates a partial top plan view of the apparatus of FIG. 1.

FIG. 2 shows a top plan view of the support frame 15.

Frame 15 comprises two halves 15*a*, 15*b* pivotable about pivot 30 between an open position and a closed position as shown. A toggle linkage mechanism 31 is operated by hydraulic ram 32 to move halves 15*a*, 15*b* between an open position and a closed, locked position as shown.

The hemicylindrical drive portion 18*a*, 18*b* (to which respective drum portions 21*a*, 21*b* are attached) are journalled in frame halves 15*a*, 15*b* in such a manner that they are supportably retained in their respective frame halves when frame 15 is in an open position.

Brackets 33, 34 respectively mounted on frame halves 15*a*, 15*b* include respective spigots and sockets (not shown) to align frame halves 15*a*, 15*b* in a closed position.

Figure 3:
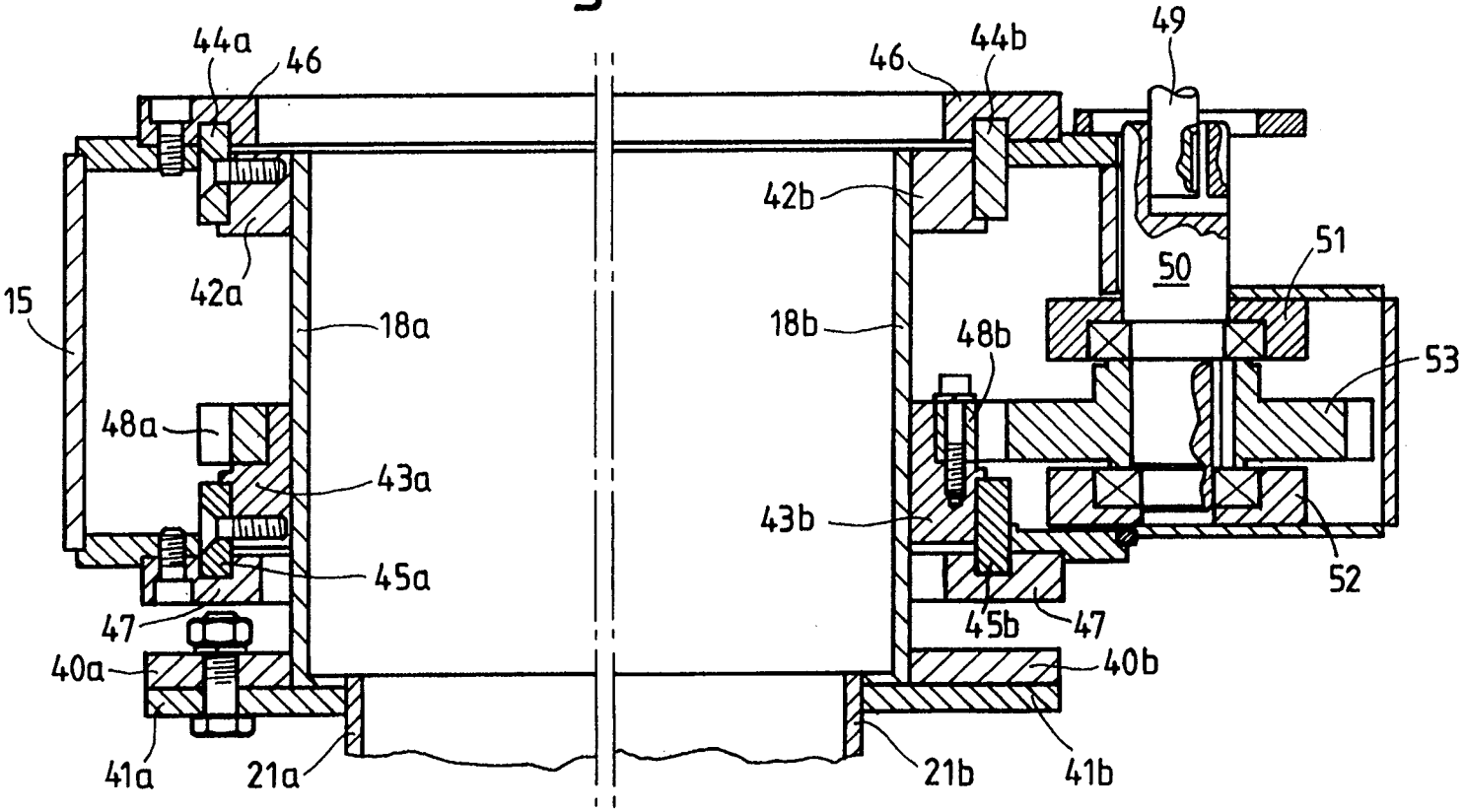
FIG. 3 illustrates a part cross sectional view of the apparatus through A—A in FIG. 1.

FIG. 3 shows a part sectional view through A—A of support frame 15 illustrated in FIGS. 1 and 2, and for the sake of clarity, certain items have been omitted.

Frame 15 comprises a generally annular, hollow box member in which drive portion 18 is rotatably journalled.

Drive portion 18 comprises hemicylindrical wall portions 18*a*, 18*b* each with semi-annular flanges 40*a*, 40*b* mounted at the lower edge thereof. The hemicylindrical halves 21*a*, 21*b* of excavating drum 21 (shown in FIG. 1) are removably attached to drive portion by bolting through semi-annular flanges 41*a*, 41*b* attached to the upper portions of drum halves 21*a*, 21*b*.

Semi annular ring members 42*a*, 42*b* and 43*a*, 43*b* are located respectively adjacent the upper and lower regions of drive portions 18*a*, 18*b*.

Mounted on ring halves 42*a*, 42*b* and 43*a*, 43*b* are semi-annular upper and lower bronze bearing strips 44*a*, 44*b* and 45*a*, 45*b* respectively. Bearing strips 44*a*, 44*b* and 45*a*, 45*b* are located in recesses formed in split upper and lower annular locating members 46, 47 respectively and such recesses form annular bearing grooves to permit rotatable journalling of drive portion 18.

Mounted on a step in ring halves 43*a*, 43*b* is a diametrically split ring or spur gear forming gear halves 48*a*, 48*b*.

A drive shaft 49 of hydraulic motor 20 (not shown) engages with a pinion shaft 50 located in bearings 51, 52 between which is mounted a drive pinion 53 on pinion shaft 50. Pinion 53 engages with the split ring or spur gear formed by gear halves 48*a*, 48*b* to cause drive portion 18 to rotate in support frame 15.

It will be seen that the manner of mounting bearing strips 44*a*, 44*b* and 45*a*, 45*b* permits support frame 15 to be pivoted to an open position whilst still supporting the drive and excavating half portions of drive portion 18 and excavating portion 19 respectively.

Figure 4:
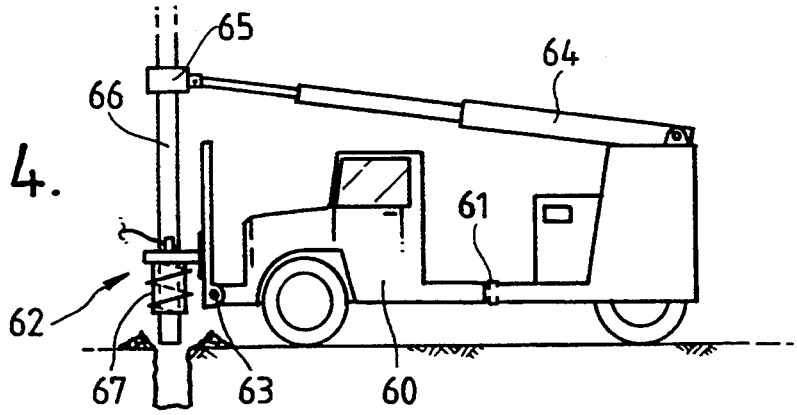
FIG. 4 illustrates schematically the excavation apparatus mounted on a mobile vehicle with a pole excavation hoist.

FIG. 4 shows schematically an alternative embodiment of the invention.

In this embodiment an articulated vehicle 60 with a central pivotal axis 61 has mounted on the front portion thereof an earth excavating apparatus 62 of the type generally shown in FIGS. 1–3. The excavating apparatus 62 is slidably mounted on a track which in turn is tiltable about pivot 63 between an upright operating position as shown and an inclined travelling position.

A telescopic boom hoist 64 mounted on the rear portion of vehicle 60 includes a clamp mechanism 65 to grasp pole 66 to enable excavation of earth from around the portion of the pole embedded in the earth. After excavation is completed, the excavating apparatus 62 is retracted and the excavating drum 67 is opened to enable the vehicle 60 to move away from the pole whilst extending boom 64 to maintain the pole 66 in a steady upright state.

With the entire embedded portion of the pole now exposed, a complete inspection may be carried out with the pole safely stabilised and if required, the normally embedded portion may be treated with a preservative, anti-fungal composition etc.

If, due to severe deterioration, the pole 66 needs replacement, the boom hoist 64 may then be actuated to extract the pole 66 from the ground, load it upon a transport vehicle and reinsert a new pole.

Figure 5:
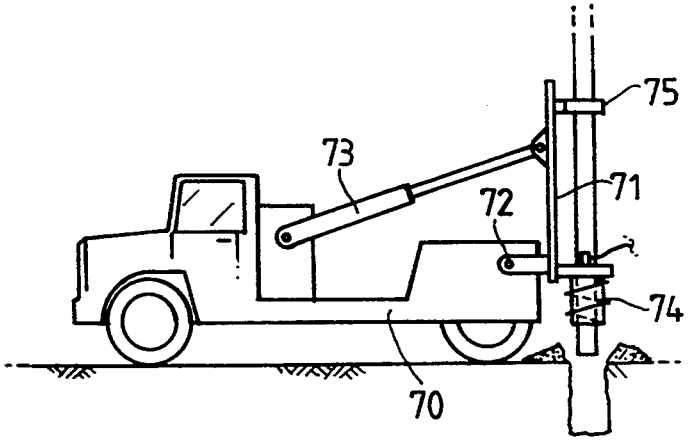
FIG. 5 shows a further variation of the apparatus of FIG. 4.

FIG. 5 shows yet another alternative embodiment of the apparatus shown in FIG. 4.

In this embodiment a vehicle 70 includes a tiltable track 71 pivoted about pivot 72 between an upright operating position as shown and a tilted travelling position (not shown) by means of hydraulic ram 73.

Slidably mounted on track 71 is an excavating apparatus 74 of the type hereinbefore described and a clamp means 75 also slidably mounted on track 71.

With the apparatus shown a pole may be excavated whilst supported by clamp means 75 and subsequently extracted from the earth. Track 71 is then tilted to a travelling position to enable transportation of the extracted pole.

Figure 6:
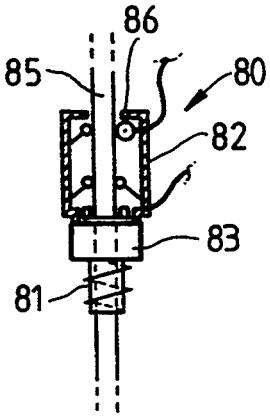
FIG. 6 illustrates an adaptation of the excavation apparatus for remote controlled excavation of submerged piles.

FIG. 6 shows a further embodiment of the invention adapted to excavate about the embedded portion of a marine piling or the like.

The apparatus 80 comprises an excavating portion 81 of the type generally described about with a frame or housing 82 mounted on the support frame 83.

The frame or housing 82 includes retractable idler rollers 84 adapted to grip the piling 85 and to align the excavating portion 81 therewith.

An advancing means 86 in the form of a toothed drive wheel or track mechanism is driven by an hydraulic motor to selectively move the apparatus 80 up or down the piling 85.

In this embodiment, the apparatus may be positioned around a piling and remotely operated to excavate around the embedded base thereon to facilitate extraction of the piling. It will be readily apparent to a skilled addressee that an apparatus according to the invention for excavation about a submerged piling may be remotely operated from a platform on the piling or from a nearby floating vessel.

Similarly the apparatus may be attached to a floating vessel in a manner similar to the embodiments illustrated in FIGS. 1, 4 or 5 or any other convenient manner.

We claim:

1. An apparatus for excavation of earth about a pole embedded in an earth surface, said apparatus comprising:

a support frame;

a substantially cylindrical earth excavation drum having at least one helical flight on an outer periphery of the drum, said drum being rotatably journalled in said support frame;

drive means to rotate said earth excavation member; and advancing means to advance said earth excavation member in a desired direction, wherein said support frame and said drum are each comprised of two or more portions movable between an open position and a closed position to embrace an upright pole for earth excavation.

2. An apparatus as claimed in claim 1 wherein said support frame is adapted for mounting on a mobile vehicle.

3. An apparatus as in claim 2 wherein said apparatus includes a tilting mechanism to selectively orient said drum for earth excavation in a predetermined direction.

4. An apparatus as in claim 3 including ground engaging stabilizers to stabilize the apparatus during operation.

5. An apparatus as in claim 1 wherein said drum includes a plurality of cutting edges located in a lower end of the drum.

6. An apparatus as in claim 1 wherein said drum, when in a closed position, comprises a substantially continuous inner wall surface.

7. An apparatus as in claim 1 wherein said earth excavation drum includes a drive portion and a removable excavation portion.

8. An apparatus as in claim 1 wherein said advancing means comprises a carriage coupled to said support frame, said carriage being movable between an advanced position and a retracted portion.

9. An apparatus as in claim 1 wherein said advancing means comprises pole engaging drive members coupled to said support frame.

10. A method of excavation of earth about a base of a pole embedded in an earth surface, said method comprising the steps of:

surrounding said pole with an earth excavation member comprising a substantially cylindrical drum having a helical flight located about the outer peripheral surface of said drum;

rotating said drum; and advancing said drum into said earth surface at a predetermined rate to a predetermined distance to effect removal of earth from around said pole.

11. A method as claimed in claim 10 wherein said pole is surrounded by said earth excavation member by locating said earth excavation member over the top of said pole and moving the earth excavation member to the base portion of said pole.

12. A method as claimed in claim 10 wherein said earth excavation member comprises at least two portions movable between an open position and a closed position wherein said excavation member is moved, in an open position towards said pole and subsequently closed to embrace said pole prior to excavation therearound.

13. A method as claimed in claim 10 wherein said pole is surrounded by an earth excavation member having at least two portions movable between an open and closed position, the method further comprising the steps of positioning the earth excavation member in an open position adjacent the pole and closing the at least two portions to surround said pole prior to rotation of said drum.

14. An apparatus for excavation of earth about a pole embedded in an earth surface, said apparatus comprising:

a support frame;

a substantially cylindrical earth excavation drum having at least one helical flight located on an outer periphery thereof, said drum being rotatably journalled in said support frame;

drive means to rotate said drum;

advancing means to advance said excavation member in a desired direction, said support frame and said drum each having two or more portions movable between an open position and a closed position to embrace an upright pole for earth excavation therearound, wherein said support frame being mounted adjacent an end of boom assembly pivotally attached to a mobile vehicle, said support frame being selectively tillable to orient said drum relative to said pole during excavation of earth from therearound.

* * * * *